US007311369B2

(12) United States Patent
Yun

(10) Patent No.: US 7,311,369 B2
(45) Date of Patent: Dec. 25, 2007

(54) APPARATUS AND METHOD FOR CORRECTING WHITE LINE OF INK-JET PRINTER

(75) Inventor: Seuk-jin Yun, Anyang (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 175 days.

(21) Appl. No.: 10/673,182

(22) Filed: Sep. 30, 2003

(65) Prior Publication Data

US 2004/0135835 A1 Jul. 15, 2004

(30) Foreign Application Priority Data

Jan. 9, 2003 (KR) ..... 10-2003-0001416

(51) Int. Cl.
*B41J 29/38* (2006.01)

(52) U.S. Cl. ..... 347/9; 347/16; 347/5

(58) Field of Classification Search ..... 347/40, 347/41, 9, 12, 13, 43, 16, 15, 5; 358/1.8; 400/705

See application file for complete search history.

(56) References Cited

U.S. PATENT DOCUMENTS 6,655,865 B2 * 12/2003 Yanagi et al. ..... 400/705
2002/0054305 A1 * 5/2002 Ogasahara et al. ..... 358/1.8
2003/0048326 A1 * 3/2003 Yamasaki et al. ..... 347/41

FOREIGN PATENT DOCUMENTS

JP 2002-225370 8/2002

OTHER PUBLICATIONS

Japanese Patent Office Action, mailed Dec. 12, 2006, and issued in corresponding Japanese Patent Application No. 2004-003959.

* cited by examiner

*Primary Examiner*—Lam Son Nguyen
(74) *Attorney, Agent, or Firm*—Staas & Halsey LLP

(57) ABSTRACT

An apparatus to correct a white line of an ink-jet printer and a method to control the apparatus including driving a pickup roller when a printing command is inputted to pickup a paper; judging whether the leading end of the paper enters or not using a paper-detection sensor; judging a corresponding overfeeding amount and overfeeding position in accordance with the type of the paper; sequentially implementing the printing and feeding in accordance with a preset printing width; and implementing the printing using dummy nozzles which are not used in the printing of the sequential implementing operation, in such a way that the printing is performed for the overfeeding amount judged in the judging operation as well as for the printing width in the sequential implementing operation, when the line positioned just before the overfeeding position judged in the judging operation is printed. When the overfeeding position of the paper is printed, the dummy nozzles are used and when the lines following the overfeeding position are printed, the nozzles located in the area retreated to the extent of the width of the area of the dummy nozzles are used. Thus, it is possible to prevent a white line from being produced due to the overfeeding.

17 Claims, 3 Drawing Sheets

APPARATUS AND METHOD FOR CORRECTING WHITE LINE OF INK-JET PRINTER

CROSS-REFERENCE TO RELATED APPLICATIONS

This application claims the benefit of Korean Application No. 2003-1416, filed Jan. 9, 2003, in the Korean Intellectual Property Office, the disclosure of which is incorporated herein by reference.

BACKGROUND OF THE INVENTION

1. Field of the Invention

The present invention relates to an apparatus that corrects a white line of an ink jet printer and a method of controlling the apparatus, and in particular, to an apparatus that corrects a white line of an ink-jet printer. The apparatus is capable of preventing a white line from being produced by using dummy nozzles when overfeeding of a recording paper causes a release of tension of the paper in a mechanical mechanism, in which a pickup roller loads the recording paper and a feed roller feeds the paper. The release of tension of the paper arises when the tail end of the paper passes out of the pickup roller. The present invention further relates to a method for controlling the apparatus.

2. Description of the Related Art

An ink-jet printer is formed with a plurality of nozzles in a head of a cartridge of a printing device. Such an ink-jet printer typically has a resolution of about 300 to 1200 DPI (Dot Per Inch) and implements mono printing or color printing depending on the type of the cartridge.

The operation process of such an ink-jet printer is described in detail with reference to FIG. 1. A paper P is loaded in a paper-loading section 10 and a pickup roller 21 picks up and feeds it to a paper transfer path, on which the transfer to print is performed.

If the paper picked up by the pickup roller 21 in this manner is detected by a paper-detection sensor 40, the paper P is fed by the compressive force between a feed roller 22 and a friction roller 23 which are rotating and consequently the paper P is transferred to a printing position in which an ink cartridge 30 is located.

If the paper is transferred to the printing position, a cartridge driving motor is driven and a belt, which is driven in cooperation with the cartridge driving motor, is driven left and right, as a result of which the cartridge mechanism slides left and right and the printing is implemented on the transferred paper P through a plurality of nozzles 31' (FIG. 3) formed in the head 31 of the cartridge 30.

Then, the paper P is gradually moved on a base frame 50 while the paper is being printed line by line by the nozzle 31', formed in the head 31 of the cartridge 30, and the printed paper P is discharged by a paper-discharging roller 24 when the printed paper P arrives at a paper-discharging port.

In this case, the paper P, picked up in the paper loading section 10, is transferred to the printing position and fed according to a preset feeding amount to print by the rotation of the feed roller 22 and the friction roller 23. However, there is a problem in that when the tail end of the paper passes out of the pickup roller 21, while the paper is being fed in a preset feeding amount, release of tension of the paper is caused, and due to the release of tension, the vertical component of feeding force exerted by the pickup roller 21 is lost, as a result of which the paper is overfed so as to exceed the preset feeding amount, and a white line is produced in the final printed paper.

Detailed description is made with reference to FIG. 4. At the moment the tail end of the paper passes out of the pickup roller 21, the feed roller 22 and the friction roller 23 feeds the paper in the preset feeding amount and the vertical component of feeding force which has been exerted by the pickup roller 21 and has held the paper is lost, as a result of which the paper is overfed to the extent of $\alpha$. That is, in the overfeeding position, the paper is overfed to the extent of the sum of the preset feeding amount a and an overfed amount $\alpha$, i.e., to the extent of $a+\alpha$. Because the nozzles 31' are controlled so that the printing is implemented in a preset printing width in the state that the paper has been overfed to the extent of $a+\alpha$, the overfed amount $\alpha$ remains without being printed. Therefore, there is a problem in that a white line is produced on the printed paper to the extent of 60 and thus deteriorates the quality printed image.

SUMMARY OF THE INVENTION

Accordingly, an aspect of the present invention is to provide an apparatus that corrects a white line of an ink-jet printer. The white line is produced when the vertical component of feeding force of a pickup roller is lost due to release of tension of a paper at the moment the tail end of the paper passes out of the pickup roller. The apparatus is capable of preventing the white line from being produced when the ink-jet printer implements the printing so that the quality of printed image can be enhanced. A further aspect of the present invention is to provide a method of controlling the apparatus.

According to an aspect of the present invention, there is provided an apparatus that corrects a white line of an ink-jet printer, comprising: a driving section which rotates one or more rollers to transfer a paper and drives an ink cartridge in response to control signals, so that the printing is implemented in a preset printing width; a memory which stores information relating to an overfeeding amount and an overfeeding position of the corresponding paper according to the type of the paper; and a control section which outputs the control signals to the driving section so that the paper is sequentially fed according to the preset printing width, wherein the control section calls the information relating to the overfeeding amount and the overfeeding position stored in the memory, judges the corresponding overfeeding amount and the overfeeding position according to the type of the paper, and outputs the control signals if it is judged that the printing position is located on the line positioned just before the overfeeding position, so that the printing is implemented by dummy nozzles corresponding to the overfeeding amount together with nozzles corresponding to the preset printing width.

The control section controls the printing in such a way that the printing is implemented by the nozzles located in the area retreated to the extent of the width of the dummy nozzle area from the normal printing area thereof until the printing is terminated starting from the line positioned just after the overfeeding position.

According to another aspect of the present invention, there is provided a method to control an apparatus to correct a white line of an ink-jet printer comprising driving a pickup roller to pickup a paper when a printing command is inputted; judging whether the leading end of the paper enters the printer using a paper-detection sensor; secondarily judging a corresponding overfeeding amount and overfeeding position in accordance with the type of the paper; sequentially implementing the printing and feeding in accordance with a preset printing width; and implementing the printing using dummy nozzles which are not used in the printing of the sequential implementing operation, in such a way that the printing is performed for the overfeeding amount judged in the secondarily judging operation as well as for the printing width of the sequential implementing operation when the line positioned just before the overfeeding position judged in the secondarily judging operation is printed.

The method according to the present invention further comprises secondarily implementing the printing using the nozzles located in the area retreated to the extent of the width of the area of the dummy nozzles used in the implementing operation from the area of the nozzles used in the sequential implementing operation, until the printing is terminated starting from the line positioned just after the line printed in the step e).

Additional and/or other aspects advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments taken in conjunction with with the accompanying drawings in which.

DETAILED DESCRIPTION OF THE PREFERRED EMBODIMENTS

Figure 1:
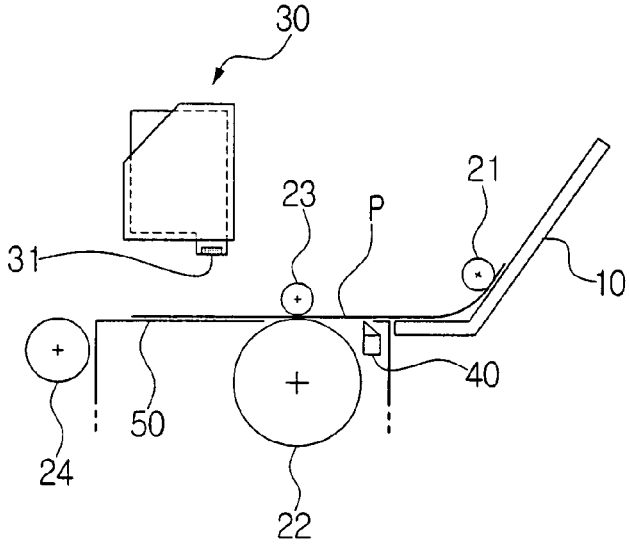
FIG.1 (PRIOR ART)
FIG. 1 is a schematic view which shows a paper transfer path of an ink-jet printer.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
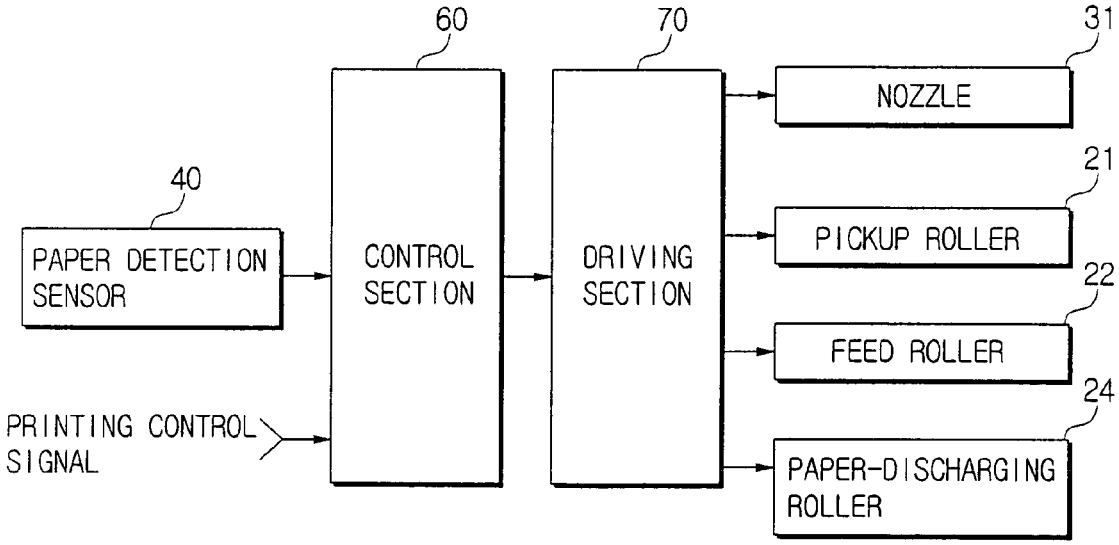
FIG. 2 is a block diagram which shows a control system according to an embodiment of the present invention.

FIG. 1 is a schematic view which shows a paper transfer path of an ink-jet printer, to which a method to control an apparatus that corrects a white line according to the present invention is applicable, and FIG. 2 is a block diagram which shows a control system that corrects the white line according to the present invention.

As shown in the drawings, the ink-jet printer according to an embodiment of the invention comprises a paper loading section 10, a pickup roller 21, a feed roller 22, a friction roller 23, a paper-discharging roller 24, an ink cartridge 30, a plurality of nozzles 31' formed in a cartridge head 31, and a paper-detection sensor 40. The ink-jet printer further comprises a control section 60 that controls the printing operation, a driving section 70 that drives the rollers 21, 22, 24 and the cartridge 30, and a memory that stores information related to an overfeeding amount and an overfeeding position in accordance with the paper. Reference numeral 50 indicates a base frame of an image formation apparatus.

The paper-loading section 10 is loaded with at least one sheet of paper P, and the pickup roller 21 is rotated by the driving section driven in response to control signals from the control section 60 and feeds the paper P loaded in the paper-loading section 10 to the printing position. When the paper P is loaded, the paper-detection sensor 40 detects the entrance of the leading end of the paper 10 and outputs a detection signal.

The feed roller 21 and the friction roller 22 are rotated as the driving section is driven, arrange the paper P, and then transfer the paper P to the printing position.

In the ink cartridge 30 of an embodiment of the present invention, the ink cartridge 30, which contains ink, repeatedly performs reciprocal movements in the left and right directions as being carried by a carriage which slides left and right by the driving section 70 in response to the control signals from the control section 60. The ink is ejected through the nozzles 31' formed in the underside of the cartridge head 31.

Figure 5:
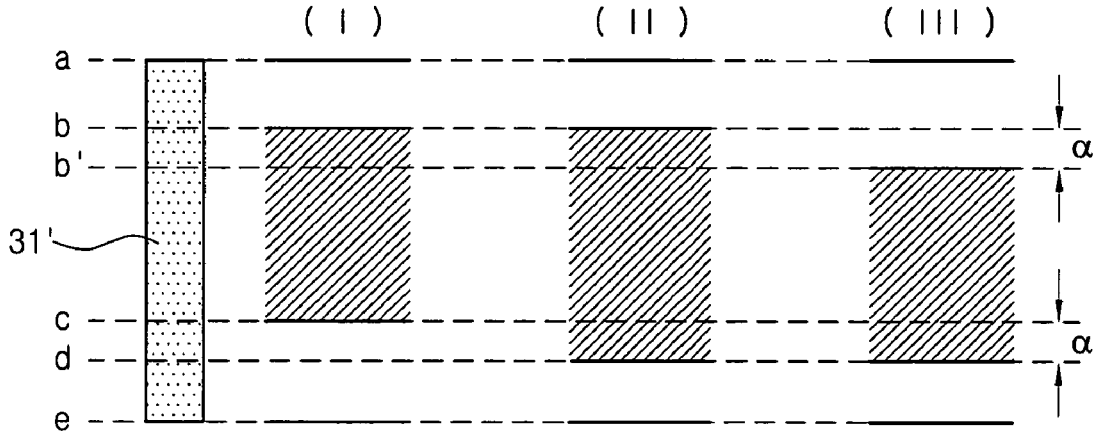
FIG. 5. shows states of a printed paper before the white line is produced, when the white line is produced, and after the white line is produced.

As shown in FIG. 5, the head 31 of the ink cartridge 30 has a plurality of nozzles 31'. The nozzles 31' are arranged so that the ink is ejected from the corresponding nozzles in accordance with the control of the control section 60 to print a preset printing width. The head 31 includes nozzles located in the b-c area used to print the preset printing width and dummy nozzles located in the a-b and c-e areas not used for that purpose.

Figure 3:
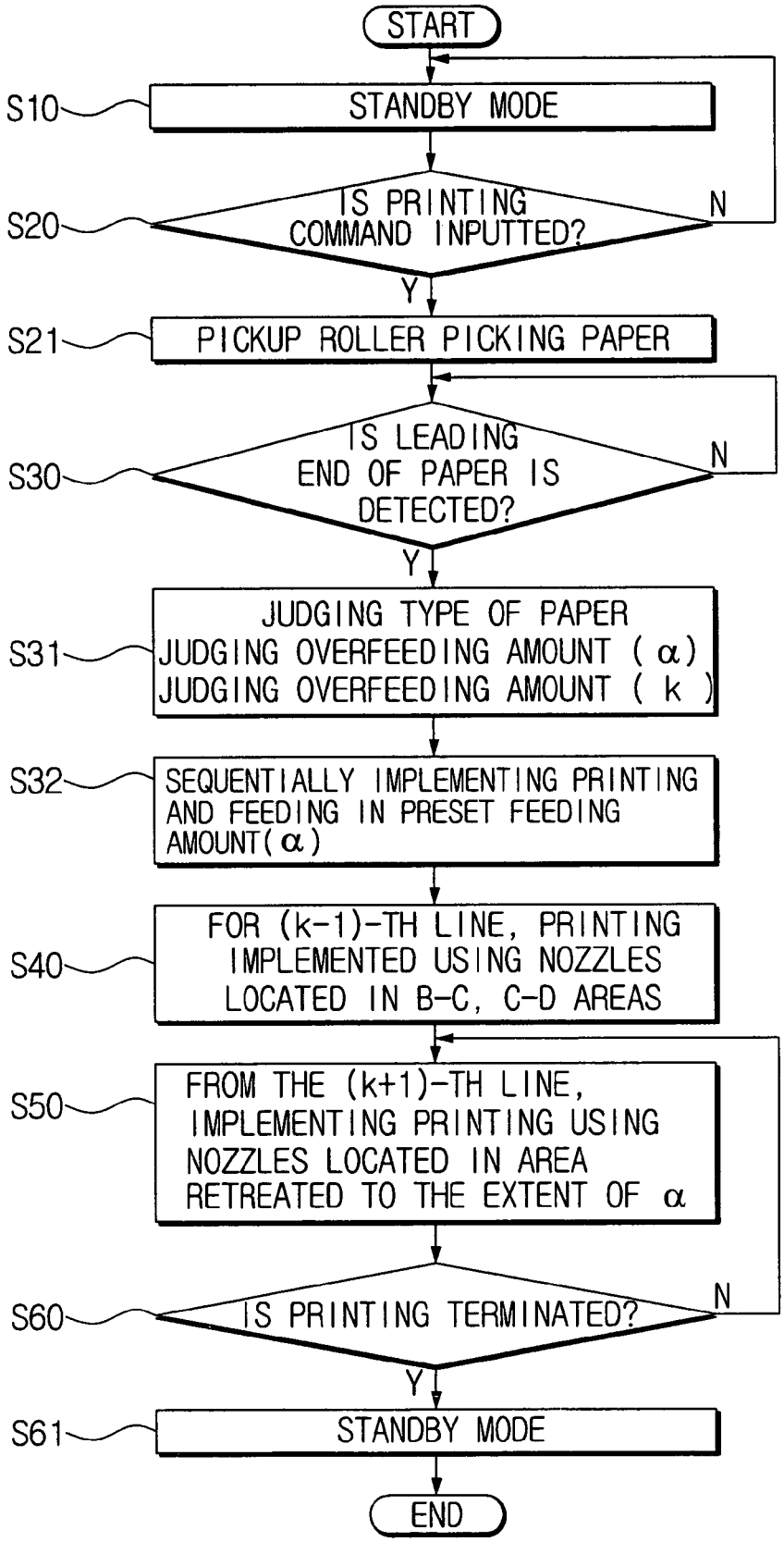
FIG. 3 is a flowchart which sequentially shows an operation control sequence of the white line correcting process implemented by the control system of FIG. 2.
Figure 4:
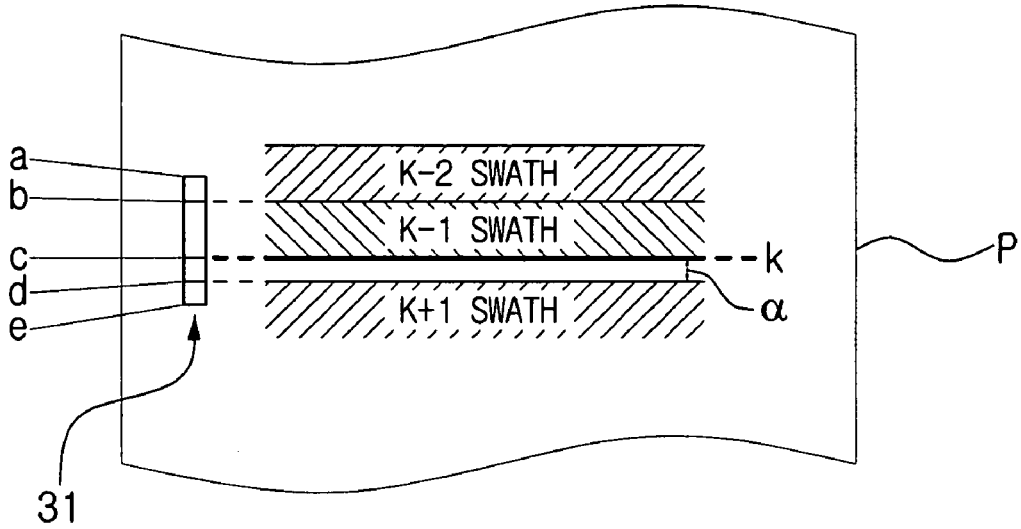
FIG.4 (PRIOR ART)
FIG. 4 is a schematic view which shows a paper on which the white line is produced, and nozzles used to print the paper.

A printing control method to correct the white line is now described with reference to FIGS. 3 and 5. FIG. 3 is a flowchart which shows the method of correcting the white line produced in the ink-jet printer constructed as described above, and FIG. 5 is a schematic view which shows printing states (I) on a normal line, (II) on an overfeeding position, and (III) on a line after overfeeding.

As shown in the drawings, if a power source is turned on, the printer is set to a standby mode and remains in the standby condition (100). If a printing command is inputted, the control section 60 outputs control signals to the driving section 70 and then the pickup roller 21 rotates so that the paper P is picked up (200, 210). If the paper P is picked up and enters the printing position, the paper-detection sensor 40 detects the entrance of the leading end of the paper and outputs the detection signal.

The control section 60 judges the type of the paper according to the size of paper, i.e., A4, A3, B5, etc. or the material of the paper in response to a printing control signal inputted from a host. Then, the control section 60, provided with the detection signal for the leading end of the paper, calls information related to the overfeeding amount and the overfeeding position stored in the memory and judges the overfeeding amount $\alpha$ and the overfeeding position k according to the type of the introduced paper 310. Meanwhile, the type of the paper can be judged by the control section 60 in response to the signal inputted from the sensor.

In addition, if the detection signal of the leading end of the paper is inputted, the control section 60 outputs control signals to the driving section 70. As the driving section 70 is driven, the feed roller 22 and the friction roller 23 arrange and transfer the paper P to the printing position 320. The paper P is fed in a preset feeding amount so that the printing is implemented in accordance with a preset printing width 320. Then, the control section 60 applies the control signals, so that the ink cartridge 30 is repeatedly reciprocated in the left and right directions by the carriage which slides left and right. Thus, the printing is implemented on the paper fed in an initially preset feeding amount by the nozzles located in the b-c area and used to print a normal line among the nozzles 31', whereby the printing is implemented in the preset printing width.

Now, description is made with reference to FIG. 5 which shows a paper on which the printing is being implemented after the white line is corrected and nozzles 31' formed in the head of the ink cartridge 30. During normal printing, the printing is implemented by nozzles 31' located in the b-c area and the driving section 70 is driven to feed the paper in the preset feeding amount, so that the printing can be implemented in the preset printing width as indicated FIG. 5(I).

When the tail end of the paper passes out of the pickup roller 21 while the paper P is being fed in the preset feeding amount, the tension of the paper is released and the vertical component of the feeding force for holding the paper in the pickup roller 21 is lost due to the loss of tension, as a result of which the paper is overfed by an overfeeding amount a in the corresponding overfeeding position k depending the type of the paper as shown in FIG. 5(II).

If the printing and feeding are sequentially implemented in the above-mentioned manner and the printing position judged in operation 310 is on the (k−1)-th line positioned just before the overfeeding position k, the printing is implemented using the dummy nozzles located in the c-d area to print the overfeeding amount a together with the nozzles located in the b-c area and used in normal printing, as shown in FIG. 5(II). That is, when printing the (k−1)-th line, the printing is implemented using nozzles located in the b-c and c-d areas 400.

From the printing of the (k+1)-th line next to the overfeeding position k, the printing is implemented using the nozzles located in the area b'-d, which is retreated to the extent of α from the b-d area. That is, until the printing is terminated starting from the (k+1)-th line on the corresponding paper, the printing is implemented using the nozzles located in the b'-d area retreated to the extent of the width of the added dummy nozzle area α from the ordinary printing area b-d 500. If the printing of the corresponding paper is terminated, the paper is discharged by the paper-discharging roller 24 and the printer is converted into the standby mode and remains in the standby condition (600, 610).

Therefore, it is possible to prevent a white line phenomenon from being produced by printing the overfeeding position of the paper using dummy nozzles and printing the lines following the overfeeding position using the nozzles located in the area retreated to the extent of the width of the used dummy nozzle area from the normal printing area.

As described above, according to the present invention, dummy nozzles are used when the printing is implemented in the overfeeding position of a paper, and then the printing is implemented using the nozzles located in the area retreated to the extent of the width of the used dummy nozzle area from the line positioned just after the overfeeding position. As a result, it is possible to prevent a white line phenomenon which arises due to the overfeeding caused when the vertical component of the feeding force for holding the paper in the pickup roller is lost. Therefore, it is possible to prevent the deterioration of quality of printed image due to the white line phenomenon.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus that corrects a white line of an ink-jet printer, comprising:

a driving section which rotates one or more rollers to transfer a paper and drives an ink cartridge in response to control signals, so that the printing is implemented in a preset printing width;

a memory which stores information relating to an overfeeding amount and an overfeeding position of the corresponding paper according to a type of the paper; and a control section which outputs the control signals to the driving section so that the paper is sequentially fed according to the preset printing width, wherein the control section calls the information relating to the overfeeding amount and the overfeeding position stored in the memory, judges the corresponding overfeeding amount and overfeeding position according to the type of the paper, and outputs control signals if the control section judges that the printing position is located on the line positioned just before the overfeeding position, so that the printing is implemented by dummy nozzles corresponding to the overfeeding amount together with nozzles corresponding to the entire preset printing width, thereby forming an overfeeding printing area that is greater than a normal printing area printed by the nozzles alone.

2. The apparatus according to claim 1, wherein the control section controls the printing in such a way that the printing is implemented by the nozzles located in the area retreated to the extent of the width of the dummy nozzle area from the normal printing area thereof until the printing is terminated starting from the line positioned just after the overfeeding position.

3. An apparatus that corrects a white line of an ink-jet printer, comprising:

a driving section which positions a paper at printing positions including a normal position and an overfeeding position corresponding to an overfeed amount of the paper, and drives an ink cartridge in response to control signals to print a line;

a memory and control section which stores the overfeeding position and outputs the control signals;

a plurality of nozzles, in the ink cartridge, printing in a normal printing area; and a plurality of dummy nozzles, in the ink cartridge, printing in the overfeeding position, wherein if the printing position is just before the overfeeding position, the dummy nozzles print a width corresponding to the overfeeding amount together with all of the nozzles printing the normal printing area, thereby forming an overfeeding printing area that is greater than the normal printing area.

4. The apparatus according to claim 3, wherein the ink cartridge repeatedly performs reciprocal left and right movements in response to the control signals.

5. The apparatus according to claim 3, wherein the nozzles and the dummy nozzles are formed in the underside of the ink cartridge.

6. The apparatus according to claim 5, wherein the printing is implemented by the nozzles located in a printing area retreated from the normal printing area by the width of the dummy nozzles until the printing is terminated starting from the line positioned just after the overfeeding position.

7. A method to control an apparatus to correct a white line of an ink-jet printer comprising:

driving a pickup roller to pick up a paper when a printing command is inputted;

judging whether a leading edge of the paper enters using a paper-detection sensor and judging a characteristic overfeeding amount and characteristic overfeeding position corresponding to the paper;

sequentially implementing the printing in a normal printing area using nozzles and feeding in accordance with a preset printing width; and employing dummy nozzles in addition to all of the nozzles to print in accordance with the judged overfeeding amount when the line positioned just before the judged overfeeding position is printed, thereby forming an overfeeding printing area that is greater than the normal printing area.

8. The method according to claim 7, wherein the judging comprises determining a type of the paper being used.

9. The method according to claim 8, wherein the judging further comprises determining the overfeeding amount and the overfeeding position according to the type of paper being used.

10. The method according to claim 9, wherein the judging comprises determining the material of the paper.

11. The method according to claim 9, wherein the judging comprises calling information related to the overfeeding amount and the overfeeding position.

12. The method according to claim 9, wherein the sequential implementing comprises outputting control signals to the driving section to repeatedly reciprocate the ink cartridge in left and right directions.

13. The method according to claim 9, wherein the sequential implementing comprises arranging and transferring the paper to the printing position.

14. The method according to claim 9, wherein the sequential implementing comprises feeding the paper in a preset feeding amount.

15. The method according to claim 9, wherein the sequential implementing comprises applying control signals to repeatedly reciprocate an ink cartridge in left and right directions.

16. The method according to claim 9, wherein the employing comprises printing the overfeeding amount together with the nozzles when the judged position is the position just before the overfeeding position.

17. The method according to claim 7, wherein the sequential implementing comprises:

outputting control signals to the driving section, if the detection signal of the leading edge of the paper is inputted;

transferring the paper to the printing position; and sending control signals to the ink cartridge to cause the ink cartridge to repeatedly reciprocate in left and right directions.

* * * * *